US007188685B2

(12) United States Patent
Downton et al.

(10) Patent No.: US 7,188,685 B2
(45) Date of Patent: Mar. 13, 2007

(54) HYBRID ROTARY STEERABLE SYSTEM

(75) Inventors: Geoff Downton, Minchinhampton (GB); Steven James Hart, Yate (GB); John David Rowatt, Pearland, TX (US)

(73) Assignee: Schlumberge Technology Corporation, Sugar Land, TX (US)

( * ) Notice: Subject to any disclaimer, the term of this patent is extended or adjusted under 35 U.S.C. 154(b) by 0 days.

(21) Appl. No.: 10/248,053

(22) Filed: Dec. 13, 2002

(65) Prior Publication Data

US 2003/0121702 A1 Jul. 3, 2003

Related U.S. Application Data

(60) Provisional application No. 60/319,035, filed on Dec. 19, 2001.

(51) Int. Cl.
*E21B 7/08* (2006.01)
*E21B 4/04* (2006.01)
*E21B 4/02* (2006.01)

(52) U.S. Cl. ..... 175/61; 175/76; 175/107; 175/104

(58) Field of Classification Search ..... 175/57, 175/61, 62, 73, 76, 92, 95, 97, 104, 106, 175/107, 317
See application file for complete search history.

(56) References Cited

U.S. PATENT DOCUMENTS

| | | | |
|---|---|---|---|
| 712,887 | A | 11/1902 | Wyczynski |
| 1,971,480 | A | 8/1934 | Earley |
| 2,319,236 | A | 5/1943 | Isaacks |
| 2,345,766 | A | 4/1944 | Miller |
| 2,585,207 | A | 2/1952 | Zublin |
| 2,687,282 | A | 8/1954 | Sanders |
| 2,694,549 | A | 11/1954 | James |
| 2,712,434 | A | 7/1955 | Giles et al. |
| 2,857,141 | A | 10/1958 | Carpenter |
| 2,876,992 | A | 3/1959 | Lindsay |
| 3,051,255 | A | 8/1962 | Deely |
| 3,062,303 | A | 11/1962 | Schultz |
| 3,068,946 | A | 12/1962 | Frisby et al. |
| 3,092,188 | A | 6/1963 | Farris |
| 3,098,534 | A | 7/1963 | Carr et al. |
| 3,104,726 | A | 9/1963 | Davis |
| 3,123,162 | A | 3/1964 | Rowley |
| 3,129,776 | A | 4/1964 | Mann |
| 3,225,843 | A | 12/1965 | Ortloff et al. |
| 3,305,771 | A | 2/1967 | Arps |

(Continued)

FOREIGN PATENT DOCUMENTS

EP 0 343 800 A2 11/1989

(Continued)

*Primary Examiner*—Jennifer H. Gay
(74) *Attorney, Agent, or Firm*—Matthias Abrell; Brigitte L. Echols; Dale V. Gandier

(57) ABSTRACT

A bottom hole assembly is rotatably adapted for drilling directional boreholes into an earthen formation. It has an upper stabilizer mounted to a collar, and a rotary steerable system. The rotary steerable system has an upper section connected to the collar, a steering section, and a drill bit arranged for drilling the borehole attached to the steering section. The steering section is joined at a swivel with the upper section. The steering section is actively tilted about the swivel. A lower stabilizer is mounted upon the steering section such that the swivel is intermediate the drill bit and the lower stabilizer.

6 Claims, 1 Drawing Sheet

U.S. PATENT DOCUMENTS

| | | | | |
|---|---|---|---|---|
| 3,309,656 | A | | 3/1967 | Godbey |
| 3,370,657 | A | | 2/1968 | Antle |
| 3,457,999 | A | | 7/1969 | Massey |
| 3,512,592 | A | | 5/1970 | Kellner |
| 3,561,549 | A | | 2/1971 | Garrison et al. |
| 3,575,247 | A | | 4/1971 | Feenstra |
| 3,637,032 | A | | 1/1972 | Jeter |
| 3,667,556 | A | | 6/1972 | Henderson |
| 3,743,034 | A | | 7/1973 | Bradley |
| 3,799,279 | A | | 3/1974 | Farris |
| 3,878,903 | A | | 4/1975 | Cherrington |
| 3,888,319 | A | | 6/1975 | Bourne, Jr. et al. |
| 3,903,974 | A | | 9/1975 | Cullen |
| 3,974,886 | A | | 8/1976 | Blake, Jr. |
| 3,997,008 | A | | 12/1976 | Kellner |
| 4,022,287 | A | | 5/1977 | Lundstrom et al. |
| 4,027,301 | A | | 5/1977 | Mayer |
| 4,040,494 | A | | 8/1977 | Kellner |
| 4,040,495 | A | | 8/1977 | Kellner et al. |
| 4,076,084 | A | | 2/1978 | Tighe |
| 4,080,115 | A | | 3/1978 | Sims et al. |
| 4,152,545 | A | | 5/1979 | Gilbreath, Jr. et al. |
| 4,184,553 | A | | 1/1980 | Jones, Jr. et al. |
| 4,185,704 | A | | 1/1980 | Nixon, Jr. |
| 4,190,123 | A | | 2/1980 | Roddy |
| 4,211,292 | A | | 7/1980 | Evans |
| 4,241,796 | A | | 12/1980 | Green et al. |
| 4,270,619 | A | | 6/1981 | Base |
| 4,291,773 | A | | 9/1981 | Evans |
| 4,305,474 | A | | 12/1981 | Farris et al. |
| 4,351,037 | A | | 9/1982 | Scherbatskoy |
| 4,357,634 | A | | 11/1982 | Chung |
| 4,388,974 | A | | 6/1983 | Jones, Jr. et al. |
| 4,394,881 | A | | 7/1983 | Shirley |
| 4,407,377 | A | | 10/1983 | Russell |
| 4,416,339 | A | | 11/1983 | Baker et al. |
| 4,428,441 | A | | 1/1984 | Dellinger |
| 4,449,595 | A | | 5/1984 | Holbert |
| 4,456,080 | A | | 6/1984 | Holbert |
| 4,461,359 | A | | 7/1984 | Jones, Jr. et al. |
| 4,465,147 | A | | 8/1984 | Feenstra |
| 4,491,187 | A | | 1/1985 | Russell |
| 4,492,276 | A | | 1/1985 | Kamp |
| 4,515,225 | A | | 5/1985 | Dailey |
| 4,523,652 | A | | 6/1985 | Schuh |
| 4,560,013 | A | | 12/1985 | Beimgraben |
| 4,572,305 | A | | 2/1986 | Swietlik |
| 4,577,701 | A | | 3/1986 | Dellinger et al. |
| 4,635,736 | A | | 1/1987 | Shirley |
| 4,637,479 | A | | 1/1987 | Leising |
| 4,638,873 | A | | 1/1987 | Welborn |
| 4,655,289 | A | | 4/1987 | Schoeffler |
| 4,662,458 | A | | 5/1987 | Ho |
| 4,667,751 | A | | 5/1987 | Geczy et al. |
| 4,683,956 | A | | 8/1987 | Russell |
| 4,690,229 | A | | 9/1987 | Raney |
| 4,697,651 | A | | 10/1987 | Dellinger |
| 4,699,224 | A | | 10/1987 | Burton |
| 4,714,118 | A | | 12/1987 | Baker et al. |
| 4,732,223 | A | | 3/1988 | Schoeffler et al. |
| 4,739,843 | A | | 4/1988 | Burton |
| 4,763,258 | A | | 8/1988 | Engelder |
| 4,787,093 | A | | 11/1988 | Rorden |
| 4,807,708 | A | | 2/1989 | Forrest et al. |
| 4,811,798 | A | | 3/1989 | Falgout, Sr. et al. |
| 4,821,815 | A | | 4/1989 | Baker et al. |
| 4,821,817 | A | | 4/1989 | Cendre et al. |
| 4,836,301 | A | | 6/1989 | Van Dongen et al. |
| 4,842,083 | A | | 6/1989 | Raney |
| 4,844,178 | A | | 7/1989 | Cendre et al. |
| 4,848,488 | A | | 7/1989 | Cendre et al. |
| 4,848,490 | A | | 7/1989 | Anderson |
| 4,854,397 | A | | 8/1989 | Warren et al. |
| 4,854,403 | A | | 8/1989 | Ostertag et al. |
| 4,858,705 | A | | 8/1989 | Thiery |
| 4,867,255 | A | | 9/1989 | Baker et al. |
| 4,880,067 | A | | 11/1989 | Jelsma |
| 4,886,130 | A | | 12/1989 | Evans |
| 4,895,214 | A | | 1/1990 | Schoeffler |
| 4,901,804 | A | | 2/1990 | Thometz et al. |
| 4,905,774 | A | | 3/1990 | Wittrisch |
| 4,908,804 | A | | 3/1990 | Rorden |
| 4,938,298 | A | | 7/1990 | Rehm |
| 4,947,944 | A | | 8/1990 | Coltman et al. |
| 4,948,925 | A | | 8/1990 | Winters et al. |
| 4,951,760 | A | | 8/1990 | Cendre et al. |
| 4,995,465 | A | | 2/1991 | Beck et al. |
| 5,000,272 | A | | 3/1991 | Wiebe et al. |
| 5,038,872 | A | | 8/1991 | Shirley |
| 5,050,692 | A | | 9/1991 | Beimgraben |
| 5,052,501 | A | | 10/1991 | Wenzel et al. |
| RE33,751 | E | | 11/1991 | Geczy et al. |
| 5,065,825 | A | | 11/1991 | Bardin et al. |
| 5,070,950 | A | | 12/1991 | Cendre et al. |
| 5,099,934 | A | | 3/1992 | Barr |
| 5,103,919 | A | | 4/1992 | Warren et al. |
| 5,109,935 | A | | 5/1992 | Hawke |
| 5,113,953 | A | | 5/1992 | Noble |
| 5,117,927 | A | | 6/1992 | Askew |
| 5,131,479 | A | | 7/1992 | Boulet et al. |
| 5,139,094 | A | | 8/1992 | Prevedel et al. |
| 5,160,925 | A | | 11/1992 | Dailey et al. |
| 5,163,521 | A | | 11/1992 | Pustanyk et al. |
| 5,181,576 | A | | 1/1993 | Askew et al. |
| 5,186,264 | A | | 2/1993 | du Chaffaut |
| 5,213,168 | A | | 5/1993 | Warren et al. |
| 5,220,963 | A | | 6/1993 | Patton |
| 5,224,558 | A | | 7/1993 | Lee |
| 5,265,682 | A | | 11/1993 | Russell et al. |
| 5,265,687 | A | | 11/1993 | Gray |
| 5,305,830 | A | | 4/1994 | Wittrisch |
| 5,305,838 | A | * | 4/1994 | Pauc ..... 175/73 |
| 5,311,952 | A | | 5/1994 | Eddison et al. |
| 5,311,953 | A | | 5/1994 | Walker |
| 5,316,093 | A | | 5/1994 | Morin et al. |
| 5,325,714 | A | | 7/1994 | Lende et al. |
| 5,332,048 | A | | 7/1994 | Underwood et al. |
| 5,341,886 | A | | 8/1994 | Patton |
| 5,343,966 | A | | 9/1994 | Wenzel et al. |
| 5,375,098 | A | | 12/1994 | Malone et al. |
| 5,390,748 | A | | 2/1995 | Goldman |
| 5,410,303 | A | | 4/1995 | Comeau et al. |
| 5,421,420 | A | | 6/1995 | Malone et al. |
| 5,467,834 | A | * | 11/1995 | Hughes et al. ..... 175/61 |
| 5,484,029 | A | * | 1/1996 | Eddison ..... 175/73 |
| 5,507,353 | A | | 4/1996 | Pavone |
| 5,520,255 | A | | 5/1996 | Barr et al. |
| 5,520,256 | A | | 5/1996 | Eddison |
| 5,529,133 | A | | 6/1996 | Eddison |
| 5,553,678 | A | | 9/1996 | Barr et al. |
| 5,553,679 | A | | 9/1996 | Thorp |
| 5,582,259 | A | | 12/1996 | Barr |
| 5,594,343 | A | | 1/1997 | Clark et al. |
| 5,602,541 | A | | 2/1997 | Comeau et al. |
| 5,603,385 | A | | 2/1997 | Colebrook |
| 5,617,926 | A | * | 4/1997 | Eddison et al. ..... 175/61 |
| 5,673,763 | A | | 10/1997 | Thorp |
| 5,685,379 | A | | 11/1997 | Barr et al. |
| 5,695,015 | A | | 12/1997 | Barr et al. |
| 5,706,905 | A | | 1/1998 | Barr |
| 5,738,178 | A | | 4/1998 | Williams et al. |
| 5,778,992 | A | | 7/1998 | Fuller |
| 5,803,185 | A | | 9/1998 | Barr et al. |
| 5,812,068 | A | | 9/1998 | Wisler et al. |

| | | | | | |
|---|---|---|---|---|---|
| 5,842,149 | A | | 11/1998 | Harrell et al. | |
| 5,875,859 | A | | 3/1999 | Ikeda et al. | |
| 5,959,380 | A | | 9/1999 | Gillett et al. | |
| 5,971,085 | A | | 10/1999 | Colebrook | |
| 6,047,784 | A | * | 4/2000 | Dorel | 175/61 |
| 6,082,470 | A | | 7/2000 | Webb et al. | |
| 6,089,332 | A | | 7/2000 | Barr et al. | |
| 6,092,610 | A | * | 7/2000 | Kosmala et al. | 175/61 |
| 6,109,372 | A | * | 8/2000 | Dorel et al. | 175/61 |
| 6,116,354 | A | | 9/2000 | Buytaert | |
| 6,129,160 | A | * | 10/2000 | Williams et al. | 175/107 |
| 6,158,529 | A | * | 12/2000 | Dorel | 175/61 |
| 6,216,802 | B1 | * | 4/2001 | Sawyer | 175/73 |
| 6,513,606 | B1 | * | 2/2003 | Krueger | 175/61 |
| 2001/0052427 | A1 | * | 12/2001 | Eppink et al. | 175/40 |
| 2002/0175003 | A1 | * | 11/2002 | Pisoni et al. | 175/74 |
| 2003/0127252 | A1 | * | 7/2003 | Downton et al. | 175/73 |
| 2003/0146022 | A1 | * | 8/2003 | Krueger | 175/61 |

FOREIGN PATENT DOCUMENTS

| | | | |
|---|---|---|---|
| EP | 0 594 418 | A1 | 4/1994 |
| EP | 0 685 623 | A2 | 12/1995 |
| EP | 0 459 008 | B1 | 5/1996 |
| EP | 0 520 733 | B1 | 6/1996 |
| EP | 0 744 526 | A1 | 11/1996 |
| EP | 0 762 606 | A2 | 3/1997 |
| EP | 0 530 045 | B1 | 4/1997 |
| EP | 0 770 760 | A1 | 5/1997 |
| EP | 0 841 462 | A2 | 5/1998 |
| EP | 0 874 128 | A2 | 10/1998 |
| EP | 0 677 640 | B1 | 9/1999 |
| EP | 0 685 626 | B1 | 8/2000 |
| EP | 0 728 907 | B1 | 8/2000 |
| EP | 0 728 908 | B1 | 8/2000 |
| EP | 0 728 909 | B1 | 8/2000 |
| EP | 0 728 910 | B1 | 8/2000 |
| GB | 2 154 485 | A | 9/1985 |
| GB | 2 172 324 | A | 9/1986 |
| GB | 2 172 325 | A | 9/1986 |
| GB | 2 177 738 | A | 1/1987 |
| GB | 2 183 272 | A | 6/1987 |
| GB | 2 183 694 | A | 6/1987 |
| GB | 2 246 151 | A | 1/1992 |
| GB | 2 257 182 | A | 1/1993 |
| GB | 2 259 316 | A | 3/1993 |
| GB | 2285651 | A | 7/1995 |
| GB | 2 289 907 | A | 12/1995 |
| GB | 2 289 908 | A | 12/1995 |
| GB | 2 289 909 | A | 12/1995 |
| GB | 2 290 097 | A | 12/1995 |
| GB | 2 290 356 | A | 12/1995 |
| GB | 2 298 215 | A | 8/1996 |
| GB | 2 298 216 | A | 8/1996 |
| GB | 2 298 217 | A | 8/1996 |
| GB | 2 298 218 | A | 8/1996 |
| GB | 2 301 386 | A | 12/1996 |
| GB | 2 304 756 | A | 3/1997 |
| GB | 2 306 529 | A | 7/1997 |
| GB | 2 312 905 | A | 11/1997 |
| GB | 2 322 651 | A | 9/1998 |
| GB | 2 325 016 | A | 11/1998 |
| GB | 2 328 466 | A | 2/1999 |
| GB | 2 335 450 | A | 9/1999 |
| GB | 2 336 171 | A | 10/1999 |
| GB | 2 339 222 | A | 1/2000 |
| GB | 2 339 223 | A | 1/2000 |
| GB | 2 340 153 | A | 2/2000 |
| GB | 2 342 935 | A | 4/2000 |
| GB | 2 343 470 | A | 5/2000 |
| GB | 2 344 607 | A | 6/2000 |
| GB | 2 347 951 | A | 9/2000 |
| WO | WO 96/31679 | A1 | 10/1996 |
| WO | WO 01/34935 | A1 | 5/2001 |

* cited by examiner

HYBRID ROTARY STEERABLE SYSTEM

BACKGROUND OF INVENTION

1. Field of the Invention

This invention relates to a bottom hole assembly comprising a rotary steerable directional drilling tool, which is useful when drilling boreholes into the earth.

2. Description of the Related Art

Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottom hole assembly (BHA) in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the BHA close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference.

In the push-the-bit rotary steerable system there is usually no specially identified mechanism to deviate the bit axis from the local BHA axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Although such distinctions between point-the-bit and push-the-bit are useful to broadly distinguish steering systems, a deeper analysis of their hole propagation properties leads one to recognize that facets of both are present in both types of deviated borehole steering systems. For example, a push-the-bit system will have a BHA that is not perfectly stiff, enabling the bit to be effectively pointed and so a proportion of hole curvature is due to the bit being pointed. Conversely, with point-the-bit systems that use a fixed bend offset, a change in hole curvature requires the bit to cut sideways until the new curvature is established. Changes in hole gauge and stabilizer wear effectively cause the bit to be pointed in a particular direction, which may or may not help the steering response, regardless of steering system type. In the extreme, push-the-bit systems that use drill bits with little or no side cutting ability may still achieve limited steering response by virtue of the aforementioned flexibility of the BHA or stabilizer/hole gauge effects.

It is into this broad classification of deviated borehole steering systems that the invention disclosed herein is launched. The hybrid steering system of the present invention breaks with the classical point-the-bit versus push-the-bit convention by incorporating both into a single scheme by design rather than circumstance.

SUMMARY OF INVENTION

Disclosed herein is a bottom hole assembly rotatably adapted for drilling directional boreholes into earthen formations. It has an upper stabilizer mounted to a collar, and a rotary steerable system. The rotary steerable system has an upper section connected to the collar, a steering: section, and a drill bit arranged for drilling the borehole attached to the steering section. The steering section is joined at a swivel with the upper section and arranged with a lower stabilizer mounted on the upper section. The rotary steerable system is adapted to transmit a torque from the collar to the drill bit. The swivel is actively tilted intermediate the drill bit and the lower stabilizer by a plurality of intermittently activated motors powered by a drilling fluid to maintain a desired drilling direction as the bottom hole assembly rotates. No portion of the rotary steerable system exposed to the earthen formation is stationary with respect to the earthen formation while drilling In this embodiment, the location of the contact between the drill bit and the formation is defined by the offset angle of the axis of the drill bit from the tool axis and the distance between the drill bit and the swivel. The theoretical build rate of the tool is then defined by the radius of curvature of a circle determined by this contact point and the two contact points between the formation and the upper stabilizer and lower stabilizer.

A bottom hole assembly is also disclosed that is rotatably adapted for drilling directional boreholes into an earthen formation. It has an upper stabilizer mounted to a collar, and a rotary steerable system. The rotary steerable system has an upper section connected to the collar, a steering section, and a drill bit arranged for drilling the borehole attached to the steering section. The rotary steerable system is adapted to transmit a torque from the collar to the drill bit. The steering section is joined at a swivel with the upper section. The steering section is actively tilted about the swivel. A lower stabilizer is mounted upon the steering section such that the swivel is intermediate the drill bit and the lower stabilizer.

A drilling fluid actuated motor system is used to point the portion of the steering section rigidly attached to the drill bit. Such a system utilizes the "free" hydraulic energy available in the drilling fluid as it is pumped through the tool to displace motors and/or pads to control the orientation of the tool while drilling. This minimizes the amount of electrical power that must be developed downhole for toolface control. Further, control of a motor system may be accomplished by numerous mechanical and electrical means, for example rotary disc valves to port drilling fluid to the requite actuators or similar arrangements utilizing solenoid actuated valves, affording great flexibility in implementation.

DETAILED DESCRIPTION

Figure 1:
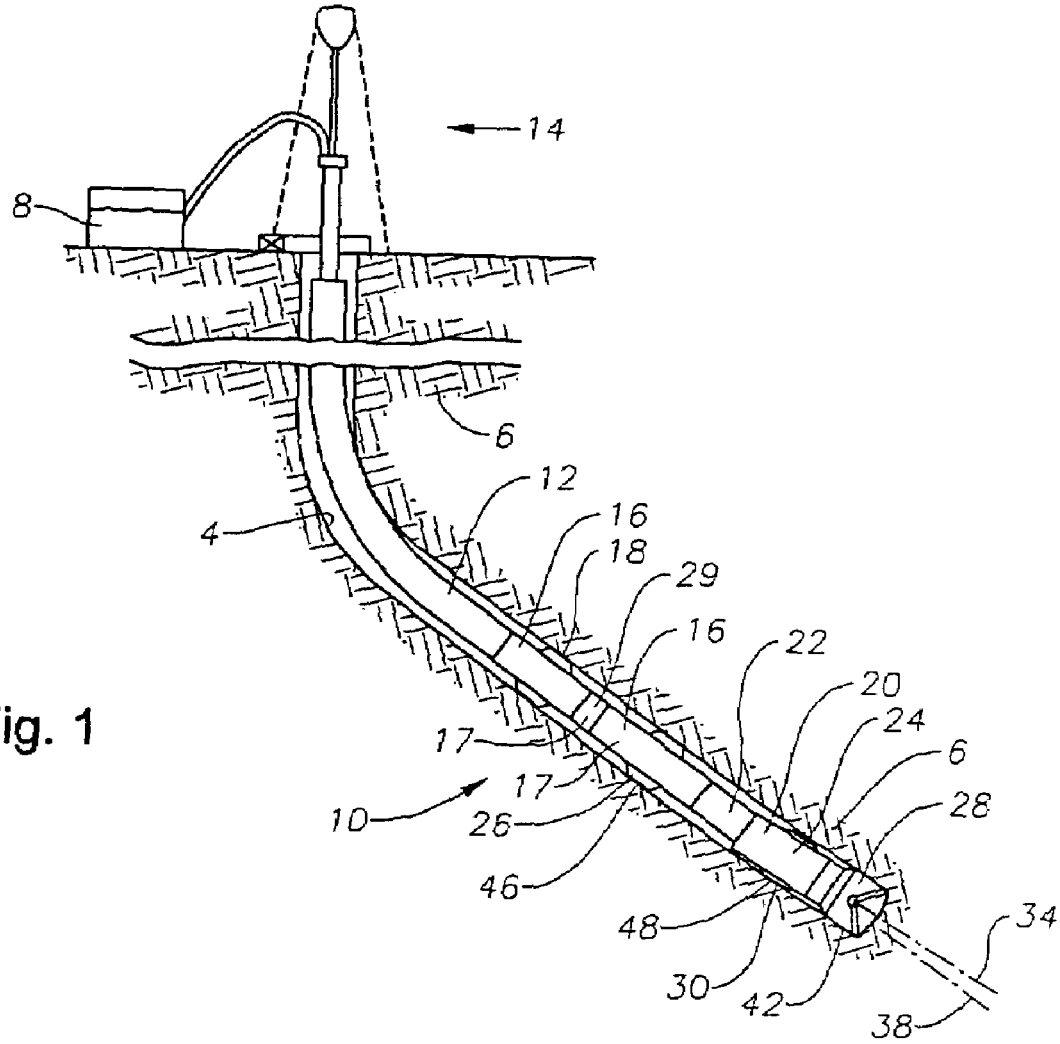
FIG. 1 is a perspective view of a bottom hole assembly within a borehole in the earth, as typically used in the practice of the present invention.

Referring now to FIG. 1, when drilling directional boreholes 4 into earthen formations 6, it is common practice to use a bottom hole assembly as shown in FIG. 1. The bottom hole assembly (BHA), generally indicated as 10, is typically connected to the end of the tubular drill string 12 which is typically rotatably driven by a drilling rig 14 from the surface. In addition to providing motive force for rotating the drill string 12, the drilling rig 14 also supplies a drilling fluid 8, under pressure, through the tubular drill string 12 to the bottom hole assembly 10. The drilling fluid 8 is typically laden with abrasive material, as it is repeatedly re-circulated through the borehole 4. In order to achieve directional control while drilling, components of the bottom hole assembly 10 may include one or more drill collars 16, one or more drill collar stabilizers 18 and a rotary steerable system 20. The rotary steerable system 20 is the lowest component of the BHA and includes an upper section 22 which typically houses the electronics and other devices necessary for control of the rotary steerable system 20, and a steering section 24.

The upper section 22 is connected to the last of the drill collars 16 or to any other suitable downhole component. Other components suited for attachment of the rotary steerable system 20 include drilling motors, drill collars, measuring while drilling tools, tubular segments, data communication and control tools, cross-over subs, etc. For convenience in the present specification, all such suitable components will henceforth be referred to as collars 17. An upper stabilizer 26 is attached to one of the collars 17, preferably the one adjacent to the rotary steerable system 20. In a first embodiment, a lower stabilizer 30 is attached to the upper section 22. The steering section 24 also includes a drill bit 28, and, in a second embodiment, the lower stabilizer 30.

Figure 2:
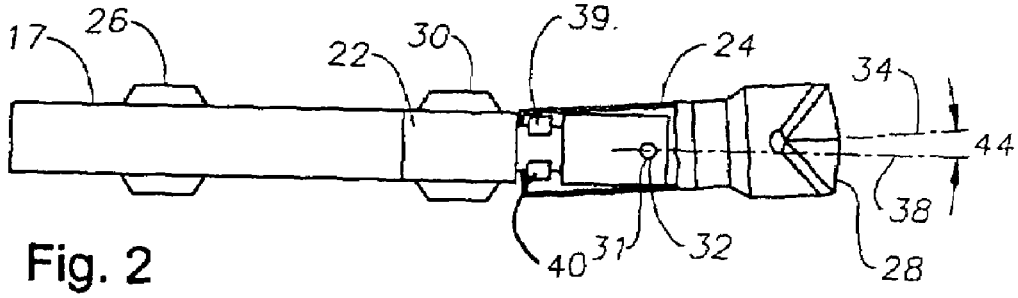
FIG. 2 is a partial section view of a first embodiment of the hybrid rotary steerable tool of the present invention.
Figure 3:
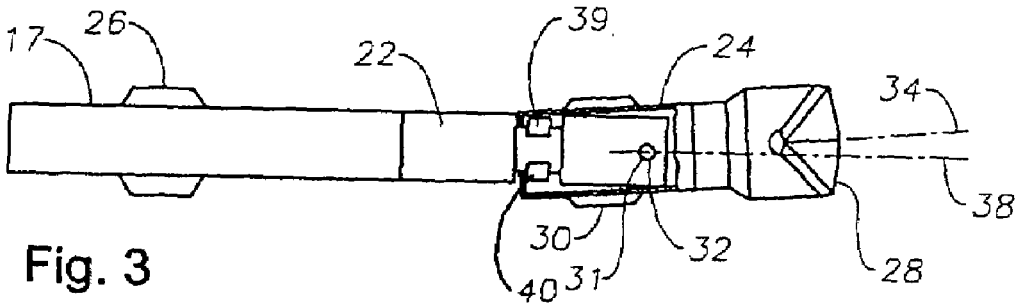
FIG. 3 is a partial section view of the preferred embodiment of the hybrid rotary steerable tool of the present invention.

A surface control system (not shown) is utilized to communicate steering commands to the electronics in the upper section 22, either directly or via a measuring while drilling module 29 included among the drill collars 16. The drill bit 28 is tilted about a swivel 31 (typically a universal joint 32) mounted in the steering section 24 (as shown in FIGS. 2 and 3). The swivel 31 itself may transmit the torque from the drill string 12 to the drill bit 28, or the torque may be separately transmitted via other arrangements. Suitable torque transmitting arrangements include many well-known devices such as splined couplings, gearing arrangements, universal joints, and recirculating ball arrangements. These devices may be either integral with the upper section 22 or the steering section 24, or they may be separately attached for ease of repair and/or replacement. The important function of the swivel 31, however, is to provide a 360 degree pivot point for the steering section 24.

The steering section 24 is intermittently actuated by one or more motors 39 about the swivel 31 with respect to the upper section 22 to actively maintain the bit axis 34 pointing in a particular direction while the whole assembly is rotated at drill sting RPM. The term "actively tilted" is meant to differentiate how the rotary steerable system 20 is dynamically oriented as compared to the known fixed displacement units. "Actively tilted" means that the rotary steerable system 20 has no set fixed angular or offset linear displacement. Rather, both angular and offset displacements vary dynamically as the rotary steerable system 20 is operated.

The use of a universal joint 32 as a swivel 31 is desirable in that it may be fitted in a relatively small space and still allow the drill bit axis 34 to be tilted with respect to the rotary steerable system axis 38 such that the direction of drill bit 28 defines the direction of the wellbore 4. That is, the direction of the drill bit 28 leads the direction of the wellbore 4. This allows for the rotary steerable system 20 to drill with little or no side force once a curve is established and minimizes the amount of active control necessary for steering the wellbore 4. Further, the collar 17 can be used to transfer torque to the drill bit 28. This allows a dynamic point-the-bit rotary steerable system 20 to have a higher torque capacity than a static point-the-bit type tool of the same size that relies on a smaller inner structural member for transferring torque to the bit. Although the preferred way of providing a swivel 31 incorporates a torque transmitting device such as a universal joint 32, other devices such as flex connections, splined couplings, ball and socket joints, gearing arrangements, etc. may also be used as a swivel 31.

A particular advantage of this arrangement is that no external part of the bottom hole assembly 10 is ever stationary with respect to the hole while drilling is in progress. This is important to avoid hang-up on obstructions, it being significantly easier to rotate over such obstructions while running in or out than a straight linear pull.

Referring now to FIGS. 2 and 3, are shown two embodiments of the rotary steerable system 20. The primary difference between the two embodiments is the placement of the lower stabilizer 30. As shown in FIG. 2 the lower stabilizer 30 may be placed on the upper section 22. Or, as shown in FIG. 3, the lower stabilizer 30 may be placed on the periphery of the steering section 24. This slight difference in the placement of the lower stabilizer 30 has significant implications on the drilling mechanics of the tool as well as the range of angular deviation of the borehole 4, also known as dogleg capability.

For both embodiments, pistons 40 are the preferred motors 39 acting on the on the periphery of the steering section 24 apply a force to tilt the drill bit 28 with respect to the tool axis such that the direction of drill bit 28 broadly defines the direction of the well. The pistons 40 may be sequentially actuated as the steering section 24 rotates, so that the tilt of the drill bit is actively maintained in the desired direction with respect to the formation 6 being drilled. Alternately, the pistons 40 may be intermittently actuated in a random manner, or in a directionally-weighted semi-random manner to provide for less aggressive steering, as the steering section 24 rotates. There are also events during drilling when it may be desirable to activate either all or none of the pistons 40 simultaneously.

When the lower stabilizer 30 is located on the upper section 22 as shown in the embodiment of FIG. 2, the rotary steerable system 20 steers in a manner similar to a classical point-the-bit system after a curve is established in the borehole 4. This embodiment relies primarily upon the end cutting action of the drill bit 28 for steering when drilling with an established curvature.

The mode is different, however, when the borehole curvature is changed or first being established. The force applied by the pistons 40 urges the drill bit so that it gradually tilts as it drills forward. It is the application of a force in this manner that provides the desirable push-the-bit mode when initially establishing, or consequently changing, the curvature of the borehole 4. Although this arrangement is an improvement over a pure point-the-bit system of the prior art, the steering mode during curvature changes is still partially point-the-bit, because both side cutting and end cutting of the bit are required.

Even so, this mode is clearly different than the traditional fixed bent-sub means for changing hole curvature. Therefore, this embodiment has advantages over the prior art because the drill bit is not forced into a set tilting displacement, as is common with similarly configured steerable systems of the prior art.

In this first embodiment, the location of the contact 42 between the drill bit 28 and the formation 6 is defined by the offset angle of the axis 44 of the drill bit 28 from the tool axis 38 and the distance between the drill bit 28 and the swivel 31.

A bottom hole assembly 10 as described, is therefore rotatably adapted for drilling directional boreholes 4 into an earthen formation 6. It has an upper stabilizer 26 mounted to a collar 17, and a rotary steerable system 20. The rotary steerable system 20 has an upper section 22 connected to the collar 17, a steering section 24, and a drill bit 28 arranged for drilling the borehole 4 attached to the steering section 24. The rotary steerable system 20 is adapted to transmit a torque from the collar 17 to the drill bit 28. The steering section 24 is joined at a swivel 31 with the upper section 22 and arranged with a lower stabilizer 30 mounted on the upper section 22. The swivel 31 is actively tilted intermediate the drill bit 28 and the lower stabilizer 30 by a plurality of intermittently activated motors 39 powered by a drilling fluid 8 to maintain a desired drilling direction as the bottom hole assembly 10 rotates. No portion of the rotary steerable system 20 exposed to the earthen formation 6 is stationary with respect to the earthen formation 6 while drilling In a second embodiment, the lower stabilizer 30 is placed on the periphery of the steering section 24 as shown in FIGS. 1 and 3, providing a different steering topology. This arrangement defines two points of contact on the periphery of the steering section 24 and the formation 6 (i.e., contact at the drill bit 28 and the lower stabilizer 30). As such, this embodiment steers like both a push-the-bit and point-the-bit system. Specifically, the periphery of the steering section 24 acts as a short rigid member with a drill bit 28 at its lower end and a nearly full gauge stabilizer 30 at its upper end. This geometry limits how much the periphery of the steering section 24 can tilt with respect to the tool axis 38. The periphery of the steering section 24 will tilt until the lower stabilizer 30 contacts the formation 6 at which point the motors 39 then act to push-the-bit through the formation 6, relying primarily on the side cutting action of the drill bit 28. As the formation 6 is removed by the side cutting action of the drill bit 28, the periphery of the steering section 24 is allowed to tilt further with respect to the tool axis 38 (i.e., the geometric constraint imposed by the formation 6 is removed) and the tool then begins to steer as a point-the-bit system, relying primarily on the end cutting action of the bit. Analysis shows that by combining aspects of both push-the-bit and point-the-bit systems, this embodiment of the hybrid design affords a means of achieving higher build rates than a point-the-bit system with the same angular deflection of the steering section 24.

The bottom hole assembly 10 of this embodiment is therefore rotatably adapted for drilling directional boreholes 4 into an earthen formation 6. It has an upper stabilizer 26 mounted to a collar 17, and a rotary steerable system 20. The rotary steerable system 20 has an upper section 22 connected to the collar 17, a steering section 24, and a drill bit 28 arranged for drilling the borehole 4 attached to the steering section 24. The rotary steerable system 20 is adapted to transmit a torque from the collar 17 to the drill bit 28. The steering section 24 is joined at a swivel 31 with the upper section 22. The steering section 24 is actively tilted about the swivel 31. A lower stabilizer 30 is mounted upon the steering section 24 such that the swivel 31 is intermediate the drill bit 28 and the lower stabilizer 30. The theoretical build rate of the tool is then defined by the radius of curvature of a circle determined by this contact point 42 and the two contact points 46, 48 between the formation and the upper stabilizer 26 and lower stabilizer 30.

The dogleg response of the hybrid rotary steerable system 20 shown in the second embodiment of FIG. 3 due to changes in actuator displacement (ecc) using consistent units is:

$$\text{Dogleg(deg/30 } m) = \frac{ecc * \frac{(d-a)}{(b-a)} * (1 + K * c) - u * (1 + K * d) + w * (1 + K * c)}{-c^2 * (1 + K * d) + d^2 * (1 + K * c)} * 180 * 30 * 2/\pi$$

Where (displacement in meters): ecc=displacement of motors 39 contributing to deflection of the swivel 31.

u=the extent of under gauge at the touch point 48 at the lower stabilizer 30 on the rotary steerable system 20.

w=the extent of under gauge at the touch point 46 at upper stabilizer 26.

a=distance from bit to the swivel 31.

b=distance from bit to motor 39.

c=distance from bit 28 to lower stabilizer 30 on the rotary steerable system 20.

d=distance from bit 28 to upper stabilizer 26.

K=a factor depending on the bits ability to cut sideways, in units of per meter. (K=0 for a bit with no side cutting ability, K=infinity for a highly aggressive bit).

To this dogleg capability is added the effects of any BHA flexure, which according to sense may increase or reduce the effective response.

In the preferred embodiment, a drilling fluid 8 actuated piston 40 is the motor 39 system used to point the portion of the steering section 24 rigidly attached to the drill bit 28. Such a system utilizes the "free" hydraulic energy available in the drilling fluid as it is pumped through the tool to displace motors 39 and/or pads to control the orientation of the tool while drilling. This minimizes the amount of electrical power that must be developed downhole for toolface control. Further, control of a motor 39 system may be accomplished by numerous mechanical and electrical means, for example rotary disc valves to port drilling fluid 8 to the requite actuators or similar arrangements utilizing electrically or mechanically actuated valves, affording great flexibility in implementation.

There are numerous advantages to control with electrically controlled valve actuators. For example, rotary steerable systems are often rotated while the drill bit 28 is pulled back from the formation 6, and therefore not drilling. This may be necessary for hole cleaning, etc. During these times, the control system still causes the motors 39 to actuate, causing unnecessary wear. An actuator may be used to shut off the drilling fluid 8 flow to the rotary disc valve when the system is required to be in neutral. This arrangement would lower the wear experienced by the moving parts when the system is rotating.

In order to create a pressure drop to provide the "free" power, rotary steerable systems 20 typically use a choke which is intended to drop the pressure of the drilling fluid 8 supplied to the rotary valve in the case of operating conditions involving high drill bit pressures drops. By incorporating an actuator in the passage to shut off the supply of drilling fluid 8 to the rotary valve, the motors 39 may be shut down independently of the rotary valve.

Another condition where rotation is needed without actuation of the motors 39 is when a zero percentage dogleg condition is being demanded. Again, under these circumstances, the control system would activate the valve to shut off the drilling fluid 8 supply to the rotary valve. This effectively holds a neutral steering condition, minimizing wear of the moving parts and proportionality increase service life. As most of the drilling conditions involve low percentage steering conditions the life of the critical wear items would be considerably enhanced.

Suitable electrically controlled actuators for these various applications include solenoids, stepping motors, pilot controlled devices, mechanical or electrical direct activated bi-stable devices, and variants such as electro-magnetic ratcheting devices, thermally activated bi-stable devices, etc.

In the preferred embodiment, the swivel 31 is a universal joint 32. This may be a two-degree of freedom universal joint 32 that allows for rotation of the periphery of the steering section 24 around its axis 34, a variable offset angle, and also torque transfer. The maximum offset angle of the periphery of the steering section 24 is limited as will be described. The universal joint 32 transfers torque from the collar 17 to the periphery of the steering section 24.

Weight is transferred from the collar 17 to the periphery of the steering section 24. The universal joint 32 and other internal parts preferably operate in oil compensated to annulus drilling fluid 8 pressure. The offset of the periphery of the steering section 24 and the contact points 42, 46, and 48 between the well bore 4 and the drill bit 28, the lower stabilizer 30 and the upper stabilizer 26 define the geometry for three point bending and dictate the dog leg capability of the tool.

A set of internal drilling fluid 8 actuated motors 39, preferably pistons 40, is located within the periphery of the steering section 24. The drilling fluid 8 may act directly on the pistons 40, or it may act indirectly through a power transmitting device from the drilling fluid 8 to an isolated working fluid such as an oil. The pistons 40 are equally spaced and extended in the radial direction. The pistons 40 are housed within the steering section 24 and operate on differential pressure developed by the pressure drop across the drill bit 28. When actuated (synchronous with drill string rotation), these pistons 40 extend and exert forces on the periphery of the steering section 24 so as to actively maintain it in a geostationary orientation and thus a fixed toolface.

The control system governing the timing of the drilling fluid 8 actuator activation is typically housed in the upper section 22 and utilizes feedback data from onboard sensors and or an MWD system to determine tool face and tool face error.

Whereas the present invention has been described in particular relation to the drawings attached hereto, it should be understood that other and further modifications apart from those shown or suggested herein, may be made within the scope and spirit of the present invention.

What is claimed is:

1. A bottom hole assembly rotatably adapted for drilling directional boreholes into an earthen formation comprising an upper stabilizer mounted to a collar, and a rotary steerable system, the rotary steerable system comprising an upper section connected to the collar, a steering section, and a drill bit arranged for drilling the borehole attached to the steering section, the rotary steerable system adapted to transmit a torque from the collar to the drill bit, the steering section joined at a swivel with the upper section, wherein a lower stabilizer is mounted on the upper section, the swivel is actively tilted intermediate the drill bit and the lower stabilizer by a plurality of intermittently activated pistons acting on the steering section relative to the upper section so as to change their angle relative to each other in order to maintain a desired drilling direction as the bottom hole assembly rotates, and wherein no portion of the rotary steerable system exposed to the earthen formation is stationary with respect to the earthen formation while drilling.

2. The bottom hole assembly of claim 1 wherein the rotary steerable system acts as a point-the-bit system after a curve is established in the borehole and as a push-the-bit system while establishing the curve.

3. The bottom hole assembly of claim 1 wherein control of at least one of the pistons is accomplished with an electrically controlled valve actuator.

4. The bottom hole assembly of claim 3 wherein the electrically controlled valve actuator is selected from a group consisting of solenoids, stepping motors, direct activated bi-stable devices, electro-magnetic ratcheting devices, and thermally activated bi-stable devices.

5. The bottom hole assembly of claim 1 wherein the rotary steerable system is effectively held in a neural steering condition while drilling continues, minimizing wear of moving parts.

6. The bottom hole assembly of claim 1 wherein the swivel is a two degree of freedom universal joint.

* * * * *